United States Patent [19]

Jordan et al.

[11] 4,036,454

[45] July 19, 1977

[54] BULK TOBACCO CONTAINER

[75] Inventors: Bertram L. Jordan; John D. Mitchell; J. C. Sessoms, Jr., all of Lewiston, N.C.

[73] Assignee: Harrington Manufacturing Company, Lewiston, N.C.

[21] Appl. No.: 704,869

[22] Filed: July 13, 1976

[51] Int. Cl.[2] ..... A24B 1/08

[52] U.S. Cl. ..... 294/5.5; 214/5.5

[58] Field of Search ..... 294/5.5; 34/201, 236, 34/237, 238; 56/27.5; 131/134, 140 R; 214/5.5; 432/500

[56] References Cited

U.S. PATENT DOCUMENTS

| | | | |
|---|---|---|---|
| 3,088,603 | 5/1963 | Boyette | 214/5.5 |
| 3,251,620 | 5/1966 | Hassler | 294/5.5 |
| 3,888,533 | 6/1975 | Long | 294/5.5 |
| 3,932,946 | 1/1976 | Johnson | 34/236 X |
| 3,935,959 | 2/1976 | Long | 294/5.5 X |
| 3,948,553 | 4/1976 | Suggs | 294/5.5 |

*Primary Examiner*—Johnny D. Cherry
*Attorney, Agent, or Firm*—Fred C. Philpitt

[57] ABSTRACT

A bulk container for tobacco leaves which includes a tine frame member adapted to fit over the open end of a leaf container and having means to lock the individual tines after insertion into the tobacco leaves.

2 Claims, 4 Drawing Figures

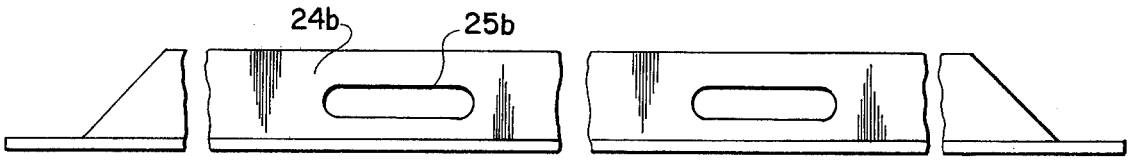
FIG. 2
FIG. 3
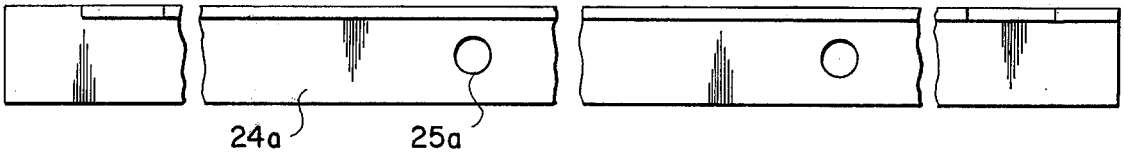
FIG. 4
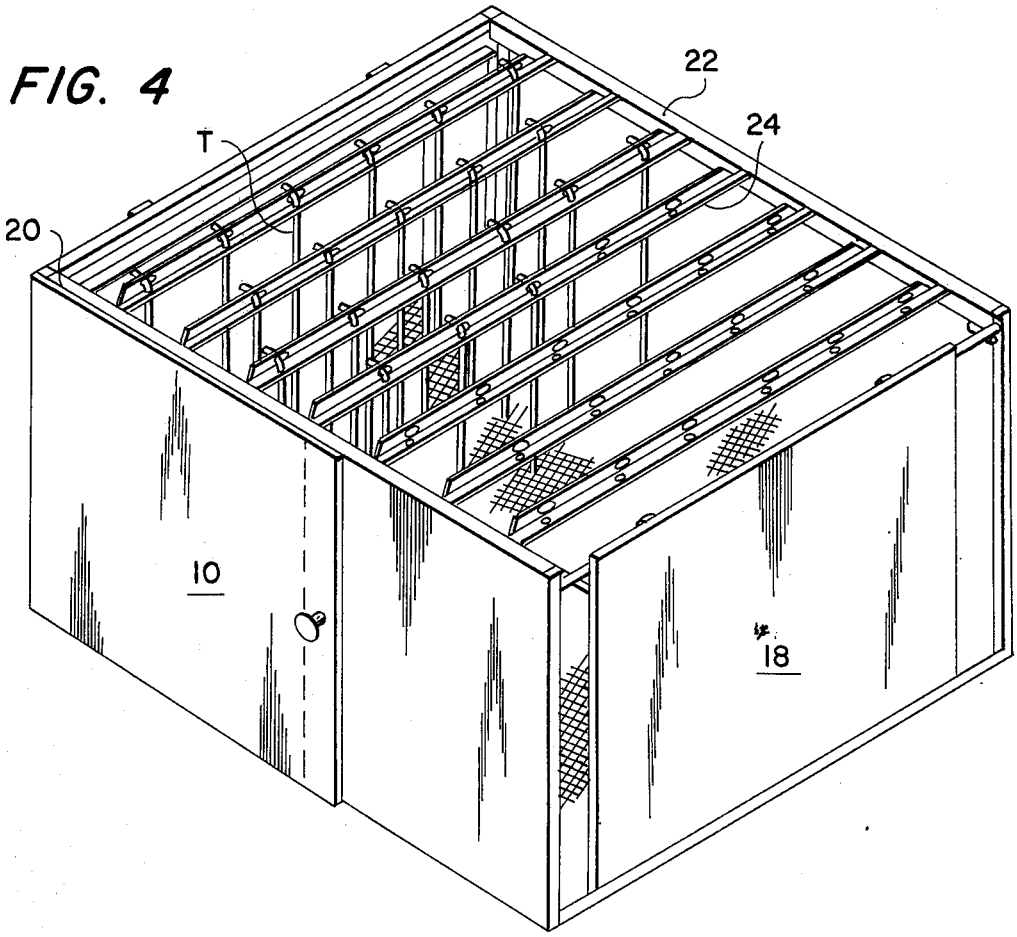

BULK TOBACCO CONTAINER

BACKGROUND

Quite a few patents have now issued which pertain to the art of bulk curing and drying whole leaf, flue-cured tobacco. One of the earliest patents in this field was Hassler U.S. Pat. No. 3,110,326. Hassler advocated the use of "racks" which were small enough so that they could be placed into a curing barn by one or two men.

In recent years the bulk curing art has developed toward the use of much larger containers for the tobacco leaves and such containers are so large and so heavy that they must be placed in a tobacco curing barn by means of a hoist, dolley, or equivalent mechanical means. A recent patent that illustrates this large type of bulk rack is Suggs U.S. Pat. No. 3,948,553. The disclosure of this patent is incorporated herein by reference since it illustrates the type of bulk container with which the present invention is concerned. Particular reference is made to the bulk container shown in FIGS. 18 and 19 of U.S. Pat. No. 3,948,553.

THE PRESENT INVENTION

The present invention relates to a bulk container for tobacco leaves that includes a. a six-sided container having at least one side completely open so as to receive a mass of tobacco leaves,
b. a tine frame which is adapted to fit over and engage the open side of said container,
c. a plurality of tines that are adapted to pass through openings in the tine frame and penetrate downwardly into the mass of tobacco within said container, each of said tines consisting of an elongated rod which is pointed at its lower end and bent over at an essentially right angle at its other end, said tine frame comprising
   1. a pair of elongated parallel side members that are spaced apart a distance corresponding to the distance between two opposite side members of said six-sided container,
   2. a plurality of parallel tine support members extending between said parallel side members and at right angles thereto, each tine support member being composed of two elongated sections of metal that are joined together at right angles, one of said sections having a plurality of holes therein through which the pointed ends of said tines are adapted to be inserted and the other of said sections having slots therein which are adapted to accommodate the bent over portions of said tines.

The invention will be better understood from the attached drawings wherein:

FIGS. 2 and 3 are side and top views respectively of a tine support member; and FIG. 4 is a perspective view of an assembled bulk container in accordance with this invention.

Figure 1:
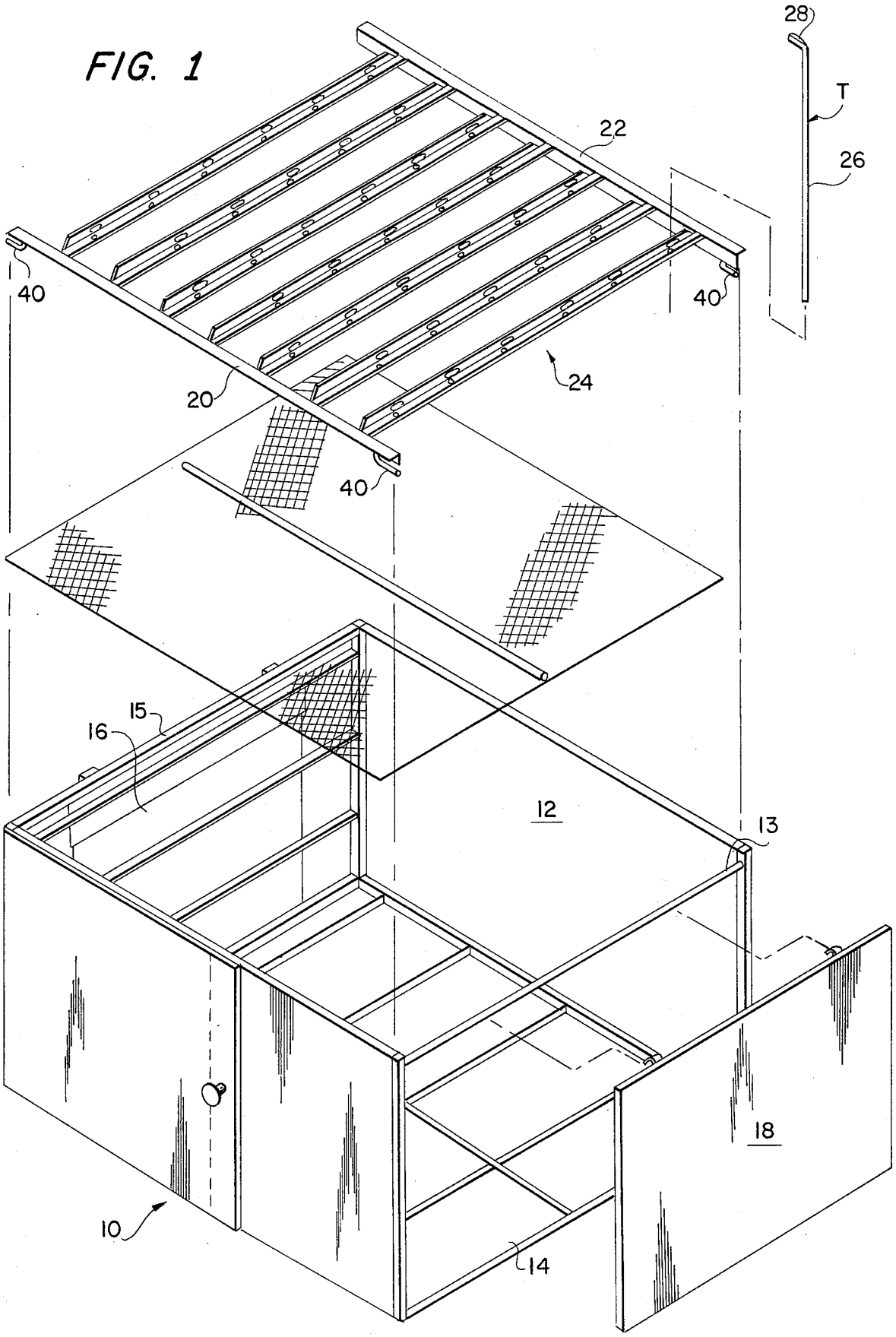
FIG. 1 is an exploded view of a bulk container in accordance with this invention.

FIG. 1 shows a six-sided container that includes sides 10 and 12, a bottom 14, a front lateral side 16, a rear lateral side 18, and an open top side (that is opposite from the bottom 14). The rear lateral side 18 is shown as being removable, since it is put in place when loading the container but is removed when the container is placed in a bulk curing barn.

FIG. 1 also shows a separate tine frame that is adapted to fit over the open top side of the container.

This tine frame includes a pair of elongated parallel side members 20 and 22 that are spaced apart a distance corresponding to the distance between sides 10 and 12. A plurality of tine support members 24 extend between side members 20 and 22. These tine support members 24 are each composed of two elongated sections of metal that are joined together at right angles, one section **24*a* (see FIGS. 2 and 3) being provided with a plurality of holes 25*a* through which the pointed end 26 of a tine T can be inserted and the other section 24*b* being provided with a plurality of slots 25*b* which are adapted to accommodate the bent over portion 28** of a tine T after the tine has been pushed down thru the mass of tobacco in the container.

FIG. 4 shows the container with the tine frame in place and tines inserted through a number of the tine support members. It will be seen that after the pointed end 26 of each tine has been pushed down through the holes **25*a* into the mass of tobacco leaves, the bent over portion 28 of the tine can be turned 90° so that the bent over portion passes through the slots 25*b* and is in effect locked into slot 25*b*. Thus, when the entire container is rotated 90° to place it in a barn for curing, the fact that bent over ends 28 of the tines are locked in slots 25*b*** will prevent the tines from moving out of the mass of tobacco.

The tine frame may be attached to the six-sided container in a number of different ways. A simple means which is shown in the drawing involves providing hook members 40 at each corner of the tine frame and these hook members can be shaped to engage any desired part of the six-sided container (e.g. the cross member 13 or cross member 15).

What is claimed is:

1. A bulk container for tobacco leaves comprising in combination:

a. a six-sided container having at least one side completely open so as to receive a mass of tobacco leaves,
b. a tine frame which is adapted to fit over and engage the open side of said container,
c. a plurality of tines that are adapted to pass through openings in the tine frame and penetrate downwardly into the mass of tobacco within said container, each of said tines consisting of an elongated rod which is pointed at its lower end and bent over at an essentially right angle at its other end, said tine frame comprising 1. a pair of elongated parallel side members that are spaced apart a distance corresponding to the distance between two opposite side members of said six-sided container,
2. a plurality of parallel tine support members extending between said parallel side members and at right angles thereto, each tine support member being composed of two elongated sections of metal that are joined together at right angles, one of said sections having a plurality of holes therein which the pointed ends of said tines are adapted to be inserted and the other of said sections having slots therein which are adapted to accomodate the bent over portions of said tines.

2. A bulk container according to claim 1 wherein said tine frame is provided with engaging means which engages a portion of said container so as to maintain said tine frame against said open side of the container.

* * * * *